US008556535B2

(12) United States Patent
Trent

(10) Patent No.: US 8,556,535 B2
(45) Date of Patent: Oct. 15, 2013

(54) SYSTEM AND METHOD FOR INSTALLING EXPANSION JOINTS

(76) Inventor: Hazell Trent, Jacksonville, FL (US)

( * ) Notice: Subject to any disclaimer, the term of this patent is extended or adjusted under 35 U.S.C. 154(b) by 255 days.

(21) Appl. No.: 12/283,028

(22) Filed: Sep. 9, 2008

(65) Prior Publication Data

US 2010/0061802 A1 Mar. 11, 2010

(51) Int. Cl.
*E01C 11/00* (2006.01)
*E01C 11/02* (2006.01)

(52) U.S. Cl.
USPC ..... 404/48; 404/68; 404/74

(58) Field of Classification Search
USPC ..... 404/47, 48, 67, 68, 74; 52/396.02–396.05
See application file for complete search history.

(56) References Cited

U.S. PATENT DOCUMENTS 1,255,611 A * 2/1918 Innes ..... 404/89
1,562,257 A * 11/1925 Rogers ..... 404/87
1,607,690 A * 11/1926 Rue ..... 249/207
1,804,215 A * 5/1931 Fischer ..... 404/87
2,106,935 A * 2/1938 Schiavi ..... 404/136
2,130,953 A * 9/1938 Heltzel ..... 404/88
2,713,710 A * 7/1955 Holland ..... 249/14
3,257,916 A * 6/1966 Palmer et al. ..... 404/64
3,431,012 A * 3/1969 Eriksson et al. ..... 294/89
4,875,801 A * 10/1989 Montrym ..... 404/48
7,547,158 B1 * 6/2009 Mucci ..... 404/47

* cited by examiner

*Primary Examiner* — Thomas B Will
*Assistant Examiner* — Abigail A Risic
(74) *Attorney, Agent, or Firm* — Arthur G. Yeager

(57) ABSTRACT

A frame for installing strips of expansion joint material in freshly-poured concrete has an elongated spine around which other elements of the frame are assembled. Spaced retainers are attached along a spine side. A flat side panel extends along another spine side. A space formed between panel and retainer receives a strip of expansion joint material. Notches are spaced along the bottom edge of side panel and serve as guides for spaced nails driven through the joint material. Spaced stakes are driven into the ground to hold the frame in place as concrete is poured around the frame. Handles are attached to the spine for removal of the frame after the concrete has been poured. The nails, immersed in the fresh concrete, hold the strip in place as the frame is lifted from the concrete and the strip remains in place within the concrete.

8 Claims, 6 Drawing Sheets

SYSTEM AND METHOD FOR INSTALLING EXPANSION JOINTS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

1. Field of the Invention

The present invention relates to systems and methods for installing expansion joints in cementitious materials.

2. Relevant Art

Concrete is a major component of construction projects. One well-known property of concrete is that temperature changes can cause it to contract and expand. Over time, such repeated contractions and expansions can crack and fracture the concrete. For this reason, expansion joints are installed within newly-poured concrete to keep it from cracking and fracturing.

Expansion joints provide a space into which separated segments of adjacent concrete slabs can expand without cracking. Expansion joints are also used when joining a newly-poured concrete slab to an existing structure to prevent damage to the structure, to the slab, or to both. One form of expansion joint is merely a space between two segments of a slab. A disadvantage with this form of expansion joint, however, is that the joint becomes a repository for rain, snow, ice, dirt, and other harmful elements.

Another form of the expansion joint is created by inserting one of a number of various types of compressible expansion joint material between segments of the slab. After the joint material has been installed within the fresh concrete, the concrete around the expansion joint is smoothed level with the top edge of the expansion joint so that the top edge of the expansion joint is exposed and visible in the finished concrete. Many types of compressible expansion joint material can be used to create an expansion joint. Examples of such expansion joint material include constructions created of fiber, sponge rubber, plastic, or cork. Note that often practitioners of the art will refer to the expansion joint material used to create an expansion joint as the expansion joint itself. For example, an uninstalled length of expansion joint material might be called an expansion joint.

One prior art technique for installing expansion joints is described in U.S. Pat. No. 4,198,176 ("the '176 patent"). The '176 patent discloses an apparatus with a trough for holding expansion joint material described as decorative joint material. The apparatus and expansion joint material it holds are positioned within the area of a pour. Concrete is then poured over the apparatus and the joint material. The apparatus holding the joint material remains embedded within the concrete. A disadvantage to this method is that the apparatus is not reusable. This leads to increased expense in installing expansion joints.

Another method for installing expansion joints in freshly-poured concrete employs grade stakes to keep a length of joint material in position and to keep it from bowing. Grade stakes are driven into the ground on one side of a length of joint material to give the joint material support. A form board is sometimes placed between the grade stakes and the joint material to provide additional support. Any existing structures, landscaping, finished concrete, or the like appearing near where an expansion joint is to be installed are usually covered with some protective material, like plastic sheeting, to protect from concrete splatter.

Concrete is then poured on either side of a staked length of joint material. For lengths of joint material set against existing structures, however, concrete is poured on only one side of the joint material since the structure abuts the opposite side. Installers then scoop some of the concrete away from the grade stakes and hammer the stakes completely into the ground until no part of a grade stake appears above ground. If a form board was used to help support the joint material, the form board is removed at this time. Note that it is also possible to pull the grade stakes out of the ground rather than hammering them in. Many installers, however, find it easier simply to hammer the grade stakes into the ground. Hammering through fresh concrete causes concrete splatter. The protective material, such as plastic sheeting, protects nearby structures, landscaping, finished concrete, and the like from the splatter. The concrete around the newly-installed expansion joint is then smoothed to approximately the height of the top edge of the joint material. This same process is done for each length of joint material in the pour area. A disadvantage of this method of installing expansion joints is the added effort and materials required.

What is needed is a system and method for installing expansion joints in freshly-poured concrete that keeps a length of expansion joint material from slipping out of position during installation, that prevents the length of joint material from deforming or breaking during installation, and that reduces the need for non-reusable materials.

SUMMARY

In accordance with this invention, installation of expansion joints in freshly-poured concrete is achieved by using a removable frame to hold expansion joint material, along with means for maintaining the position of the frame during installation, means for removing the frame from the joint material after installation, and means for retaining the joint material in place within the concrete when the frame is removed.

Expansion joints can be installed within a body of freshly-poured concrete and between freshly-poured concrete and an existing structure or other construction. Through use of this invention, the position of a length of joint material is maintained without slipping and the joint material is kept from deforming or breaking as it is installed within the concrete. Except for smoothing and finishing the concrete around the new expansion joint, installation of the joint is substantially complete when the frame is removed. Since the frame is reusable, a minimum of additional non-reusable materials are required.

A preferred embodiment of the present invention comprises a system and method that uses a removable frame for installing lengths of expansion joint material within freshly-poured concrete. The method is made up of the following steps, although one skilled in the art will appreciate that modifications to these steps can be made without departing from the scope of this invention.

First, a precut length of joint material is inserted into a frame. The frame frictionally holds the joint material throughout the installation. Extension members, such as nails, are next driven through a side of the length of joint material as a means for retaining the joint material within the concrete when the frame is removed. The frame is then moved to the location in the pour area where the expansion joint is to be installed. Stakes at the bottom of the frame are driven into the ground as a means for maintaining the position of the frame. Concrete is then poured on both sides of the frame and smoothed until the surface of the concrete is approximately level with the top edge of the length of joint material in the frame. Last, handles previously screwed into the frame are used to pull the frame upward as a means for removing the frame from the joint material left in position within the concrete. The fresh concrete weighs down upon the nails that were driven laterally into the length of joint material. The weight of the concrete, together with its viscosity, keep the nails in place. The nails, in turn, keep the length of joint material in place as the frame is pulled upward away from the joint material. At this point, installation of the expansion joint is substantially complete.

Note that depending upon the preference of the installers, the handles normally remain secured to the frame throughout the entire installation process. Or, if preferred, the handles can be removed from the frame after installation and again screwed into the frame prior to attempting to remove the frame from a length of joint material.

A removable frame is made up of a number of elements. In the present preferred embodiment, the elements of the frame are a spine, a number of spaced retainers, a side panel, a number of stakes, two or more handle receptacles, and two or more handles.

A spine is a rectangular bar around which other elements of the frame are assembled. In alternate embodiments, a spine might be of a different shape, such as a cylindrical bar. The length of the spine generally defines the length of the frame.

Retainers help secure a length of joint material in the frame. The retainers are six-sided flat plates in the general shape of a bisected octagon, although they might also be constructed in other shapes such as a square, a rectangle, or a hexagon. The retainers are attached to a single side of the spine at generally right angles to the spine. One retainer is positioned at or near each end of the spine with the other retainers generally equally spaced along the spine. Each retainer is attached to the spine so that the top edge of the retainer is level with the top of the spine.

A side panel helps secure a length of joint material in the frame and provides lateral support along the expansion joint. The side panel is a flat plate generally rectangular in shape and generally the same length as the spine. The height of the side panel is approximately equal to the combined height of the side of the spine to which the side panel is attached plus the height of a length of joint material held in the frame. The height of the side panel ensures that the bottom edge of an inserted length of joint material will be aligned with the bottom edge of the side panel. The side panel is attached lengthwise to a side of the spine that is opposite the side to which the retainers are attached. Each end of the side panel is aligned with a corresponding end of the spine and the top edge of the side panel is level with the top of the spine. The side panel is attached generally at right angles to the spine. The side panel and retainers are generally parallel to each other.

The side panel contains a number of guides spaced along its bottom edge. Each guide is an area defined by a notch in the general shape of an inverted "V." Extension members, such as elongated nails, are pushed through or driven through a length of joint material within respective notches. In this way, the guides aid in the location and placement of the nails spaced upwardly from the bottom edge of the joint material.

Stakes are generally rectangular bars that are approximately twice as long as the height of the side panel. The upper end of a stake is generally flat while the lower end is pointed. In alternate embodiments, a stake might be of a different shape, such as a cylindrical bar with a pointed end. The pointed end of the stake is driven into the ground to hold the frame in place.

The stakes are attached to the outside surface of the side panel. One stake is positioned at or near each end of the side panel with the other stakes generally equally spaced along the length of the side panel. The top of each stake is generally level with the top of the spine. Given that the stake is approximately twice as long as the side panel is tall, approximately half of the stake is adjacent to the outside surface of the side panel while approximately half extends below the side panel. Note that in alternate embodiments, the length of each stake relative to the height of a side panel might be proportionately different.

Handle receptacles, in conjunction with a like number of handles, provide a means for removing the frame from a length of joint material held in the frame. A handle receptacle is in the general shape of a cylinder and has a threaded interior with which to receive the outwardly threaded end of a handle, as discussed later. Two handle receptacles are attached to the top of the spine. One handle receptacle is located at or near each end of the spine.

Handles are in the general shape of a "T" and are formed from two joined cylinders, such as pipe. Each handle is made of a crossbar and a post with a threaded end. The crossbar and post are generally the same diameter, with the crossbar shorter than the post. The threaded end of the post screws into a handle receptacle. The non-threaded end of the post is attached to the middle portion of the crossbar to form the "T" shape.

The frame used in the present preferred embodiment is fabricated of steel. In alternate embodiments, a frame could be built of other materials, such as other types of metal, hard plastic, or a combination of these or comparable materials. A frame can be built in various lengths to accommodate the installation of expansion joints. Examples of such lengths include lengths between two and four feet for walkways, lengths between eight and sixteen feet for driveways, and lengths between sixteen and twenty feet for other applications. A frame can also be built in various heights to accommodate various depths of concrete. Examples of such depths include a depth of four inches for walkways and driveways, depths of between six and eight inches for driveways, and a depth of ten inches for driveways, slabs, and foundations. Longer frames are somewhat bendable due to their length. This allows these longer frames to be bowed so that the top edge of the joint material held by the frame forms a shallow arc in the surface of the finished concrete.

Extension members, such as nails, are used in conjunction with a removable frame to retain a length of joint material within concrete when the frame is removed from the joint material. In alternate embodiments, alternatives to nails might be used, such as metal or hard plastic dowels or the like.

BRIEF DESCRIPTION OF THE DRAWINGS

The novel features believed to be characteristic of this invention are set forth with particularity in the appended claims. The invention itself, however, both as to its organization and to its method of operation, together with further objects and advantages thereof, may be best understood by reference to the following description taken in connection with the accompanying drawings, in which:

DESCRIPTION

Figure 1:
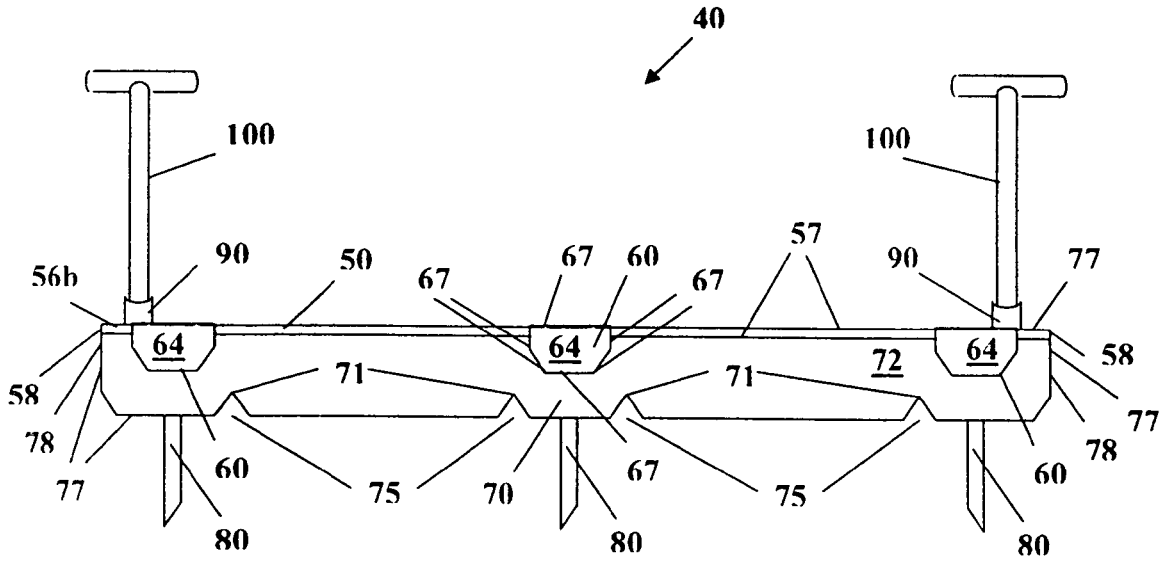
FIG. 1 is a front view of a frame for installing expansion joints in fresh concrete, in accordance with the present invention.

FIGS. 1-6 depict a removable frame that is used in conjunction with a method described with reference to FIGS. 7-11.

Description of a Preferred Frame

FIGS. 1-6 show a preferred embodiment of a frame 40 used for installing lengths of expansion joint material 210 within fresh concrete 220 (see FIG. 11), in accordance with the present invention.

Referring to FIGS. 1-4, a frame 40 comprises a spine 50, a plurality of spaced retainers 60, a side panel 70, a plurality of stakes 80, two or more handle receptacles 90, and two or more spaced handles 100. The frame 40 is oriented in a specific direction when used to install an expansion joint, thus the frame 40 can be understood to have a top and a bottom. The spine 50 is near the top of the frame 40, while the stakes 80 extend from the top to the bottom of the frame 40.

Continuing with FIGS. 1-4, a spine 50 is a generally rectangular bar around which other elements of the frame 40 are assembled. Note, however, that in an alternate embodiment, a spine 50 might be of different shape, such as a cylindrical bar. The spine 50 comprises four sides 56*a*, 56*b*, 56*c*, 56*d*, a plurality of edges 57, and two opposing ends 58. The sides 56*a*, 56*b*, 56*c*, 56*d* of the spine 50 generally form right angles at edges 57 where two sides 56*a*, 56*b*, 56*c*, 56*d* meet. A bottom side 56*c* of the spine 50 is approximately the same width as the joint material 210 to ensure that the joint material 210 fits properly into the frame 40.

Figure 2:
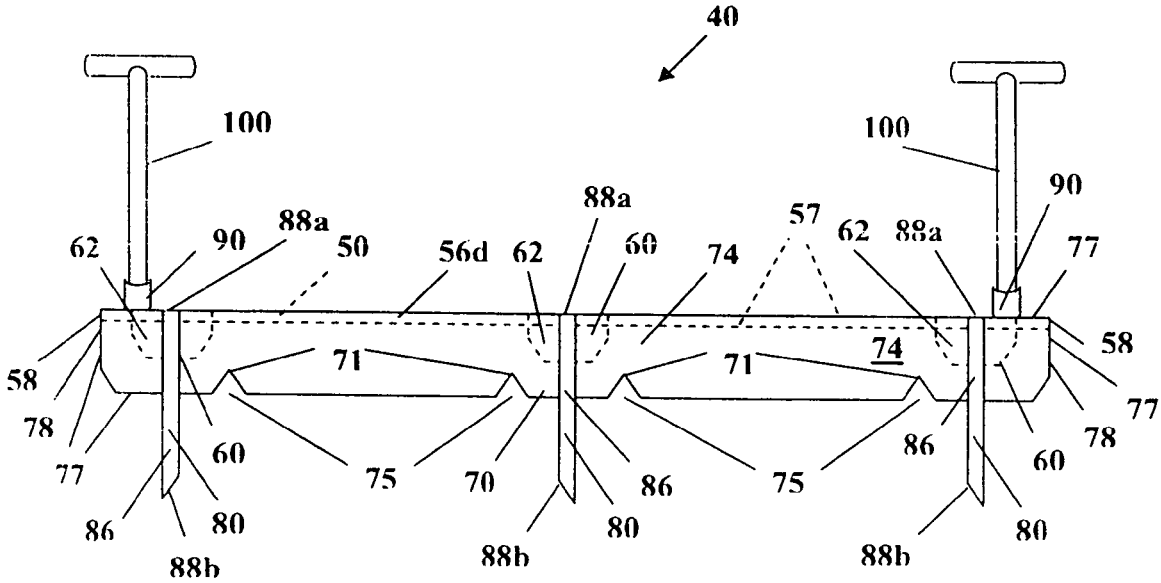
FIG. 2 is a rear view of the frame shown in FIG. 1.

Referring to FIGS. 1 and 2, in the present embodiment, a retainer 60 is a six-sided flat plate in the general shape of a bisected octagon, although in alternate embodiments a retainer 60 might be of other shapes, such as a square, a rectangle, or a hexagon. A purpose of retainers 60 is to assist in frictionally securing a length of joint material 210 in the frame 40. (See FIGS. 7-10.) The retainer 60 comprises an inner surface 62 (see FIG. 2), an outer surface 64 (see FIG. 1), and six edges 67. All retainers 60 are attached to a single side 56*b* (see FIG. 1) of the spine 50, with the retainers 60 generally being equally spaced along the side 56*b* of the spine 50 and with one retainer 60 positioned generally at each of two opposing ends 58 of the spine 50.

Continuing with FIGS. 1 and 2, each retainer 60 is attached to a first side 56*b* (see FIG. 1) of the spine 50 such that the longest edge 67 of each retainer 60 is adjacent to, and generally parallel with, the edge 57 formed by the intersection of the first side 56*b* of the spine 50 with a second side 56*a* (see FIG. 3) of the spine 50. In this way, the longest edge 67 of each retainer 60 generally fails to rise above the edge 57 of the spine 50 at any point or generally fall below the edge 57 of the spine 50 at any point. A proximate portion of an inner surface 62 (see FIG. 2) of each attached retainer 60 also is aligned generally flush against the first side 56*b* of the spine 50. This configuration of retainers 60 results in the second side 56*a* of the spine 50 being oriented as the top side 56*a* of the spine 50. Note that the portion of the inner surface 62 of the retainer 60 that includes the longest edge 67 of the retainer 60 offers the greatest surface area with which to attach and hold the retainer 60 to the side 56*b* of the spine 50.

Regarding FIGS. 1 and 2, in alternate embodiments, retainers 60 might be spaced along a side 56*b* (see FIG. 1) of a spine 50 in alternate configurations that will also frictionally secure a length of joint material 210 (see FIGS. 7-10) in a frame 40. In alternate embodiments, the number of retainers 60 might be varied, as might be the shape and size of the retainers 60 in the frame 40.

Still referring to FIGS. 1 and 2, a side panel 70 is a flat plate generally rectangular in shape and generally the same length as the spine 50. The height of the side panel 70 is approximately equal to the combined height of a side 56*d* (see FIG. 2) of the spine 50 to which the side panel 70 is attached, as described later in FIGS. 1 and 2, plus the height of a length of joint material 210 held in the frame 40, as described later in FIGS. 7 and 8. A purpose of the side panel 70 is to help to frictionally secure a length of joint material 210 in the frame 40 and to provide lateral support for the joint material 210 during pouring of concrete, hereinafter more fully described. The side panel 70 comprises an inner surface 72 (see FIG. 1), an outer surface 74 (see FIG. 2), a plurality of guides 75, a plurality of edges 77, and two opposing ends 78.

Continuing with FIGS. 1 and 2, the side panel 70 is attached lengthwise to a side 56*d* (see FIG. 2) of the spine 50 opposing the side 56*b* (see FIG. 1) of the spine 50 to which the retainers 60 are attached. A longitudinal edge 77 of the attached side panel 70 is adjacent to, and generally parallel with, the edge 57 formed by the intersection of the side 56*d* of the spine 50 with the top side 56*a* (see FIG. 3) of the spine 50. In this way, the longitudinal edge 77 of the side panel 70 generally fails to rise above the top side 56*a* of the spine 50 at any point or generally fall below the top side 56*a* of the spine 50 at any point. A proximate portion of an inner surface 72 of the attached side panel 70 is aligned generally flush against the side 56*d* of the spine 50.

Still referring to FIGS. 1 and 2, since two sides 56*a*, 56*b*, 56*c*, 56*d* (see also FIGS. 3 and 4) of the spine 50 generally form a right angle at an edge 57 where the two sides 56*a*, 56*b*, 56*c*, 56*d* meet, surfaces 72, 74 of the attached side panel 70 are aligned generally parallel to surfaces 62, 64 of the retainers 60. The side panel 70 also is attached to the spine 50 so that generally neither end 78 of the side panel 70 extends beyond the corresponding end 58 of the spine 50.

Continuing with FIGS. 1 and 2, a guide 75 is an area defined by an inverted V notch in surfaces 72, 74 of a side panel 70. The guide 75 is in the general shape of an equilateral triangle with a base collinear with a longitudinal edge 77 of the side panel 70 and an apex 71 positioned opposite the base and extending into the surfaces 72, 74 of the side panel 70.

The guides 75, in conjunction with extension members such as nails 110, provide a means for retaining a length of joint material 210 in position within concrete 220 when the frame 40 is removed from the joint material 210 and the poured concrete, as described later in FIGS. 7-11. The guide 75 provides a defined space for correctly positioning the nail 110 (see FIG. 8) so that the nails 110 are spaced above the bottom edge 77 of the side panel 70.

Still referring to FIGS. 1 and 2, the guides 75 are located along the longitudinal edge 77 of the side panel 70 opposing the longitudinal edge 77 of the side panel 70 that is attached to the side 56*d* (see FIG. 2) of the spine 50. The guides 75 are spaced along the longitudinal edge 77 of the side panel 70 such that generally at least one guide 75 is located near the middle of the side panel 70 and generally one guide 75 is located near each of opposing ends 78 of the side panel 70. The guides 75 are located so as to allow extension members such as nails 110 to be driven through a lower portion of a side 216 of a length of joint material 210. (See FIG. 8.) Note that the lower the nails 110 are positioned in the joint material 210, generally the more concrete 220 (see FIG. 11) that will be amassed above the nails 110. Since the nails 110 are held in place by the mass of concrete 220 above them, generally the deeper the nails 110 are located within the concrete 220, the better the nails 110 will hold the length of joint material 210 in place when the frame 40 is removed from the joint material 210. (See FIG. 11.) The nails 110, however, must be spaced far enough above the bottom edge 77 of the side panel 70 to ensure that the force engendered by the weight of the concrete bearing down upon the nails 110 during removal of the frame 40 does not cause the nails 110 to rip through the bottom of the joint material 210. Note that in alternate embodiments, guides 75 might be differently shaped.

Figure 3:
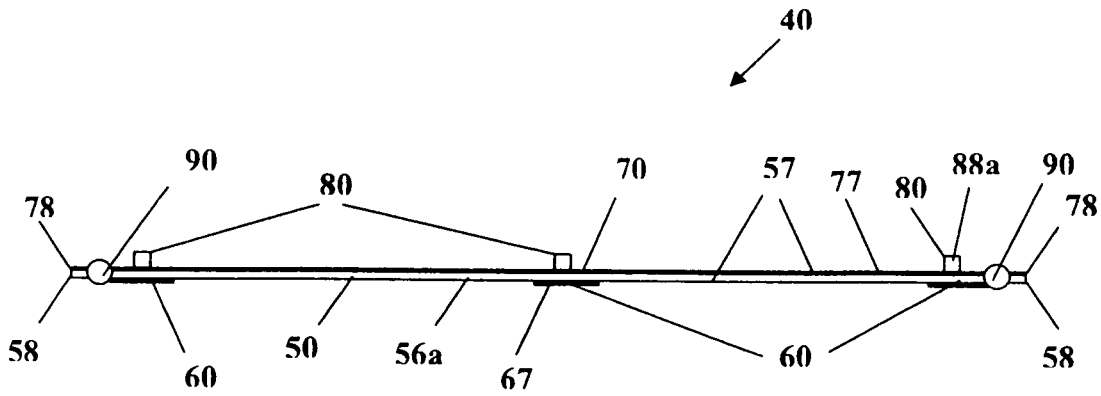
FIG. 3 is a top view of the frame shown in FIG. 1.
Figure 4:
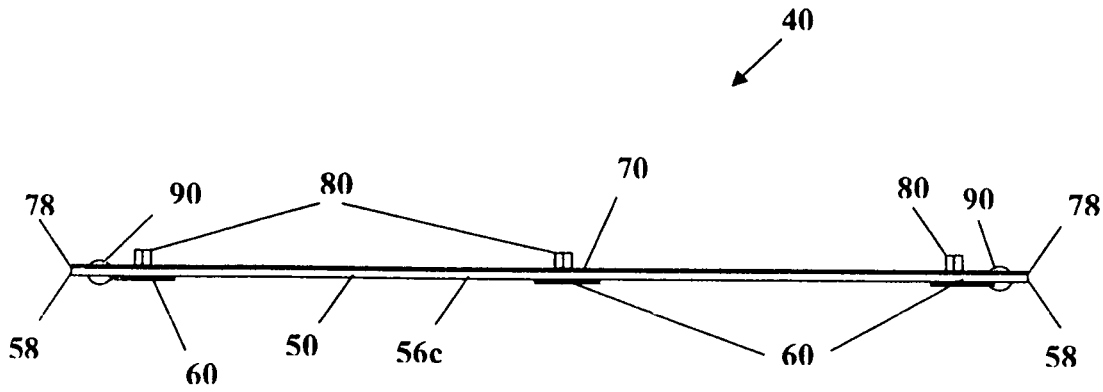
FIG. 4 is a bottom view of the frame shown in FIG. 1.

Referring to FIGS. 2 and 3, a stake 80 is a generally rectangular bar that is approximately twice as long as the height of the side panel 70. Note, however, that a stake 80 can be of a different but similar shape, such as a cylindrical bar with a pointed end. A plurality of stakes 80 provide one means for maintaining the position of the frame 40 during installation of an expansion joint. The stake 80 comprises a plurality of sides 86 (see FIG. 2) and two opposing ends 88*a*, 88*b*. One end 88*a* of the stake 80 is generally flat while the opposing end 88*b* (see FIG. 2) is pointed. The pointed end 88*b* of the stake 80 is driven into a surface, such as soil, atop which concrete 220 (see FIG. 11) is poured. All of the stakes 80 are attached to an outer surface 74 (see FIG. 2) of the side panel 70, with the stakes 80 generally equally spaced along the length of the side panel 70 and with one stake 80 generally positioned at or near each of two opposing ends 78 of the side panel 70.

Continuing with FIGS. 2 and 3, each stake 80 is attached to an outer surface 74 (see FIG. 2) of the side panel 70 such that the flat end 88*a* of the stake 80 is adjacent to, and generally parallel with, the longitudinal edge 77 of the side panel 70 that is attached to the side 56*d* (see FIG. 2) of the spine 50. In this way, the flat end 88*a* of each stake 80 generally fails to rise above the longitudinal edge 77 of the side panel 70 at any point or generally fall below the longitudinal edge 77 of the side panel 70 at any point. Since the longitudinal edge 77 of the side panel 70 is generally level with the top side 56*a* (see FIG. 3) of the spine 50, it follows that each stake 80 also is generally level with the top side 56*a* of the spine 50.

Still referring to FIGS. 2 and 3, a side 86 (see FIG. 2) of each attached stake 80 is positioned generally flush against the outer surface 74 (see FIG. 2) of the side panel 70 and aligned so that the stake 80 is generally perpendicular to the spine 50. Given that the stake 80 is approximately twice as long as the height of the side panel 70, approximately half of the stake 80 is adjacent to the outer surface 74 of the side panel 70 while approximately half of the stake 80 extends below the bottom edge 77 of the side panel 70.

Regarding FIGS. 2 and 3, in alternate embodiments, stakes 80 might be spaced along the length of the outer surface 74 (see FIG. 2) of the side panel 70 in alternate configurations that will also maintain the position of the frame 40 during installation of an expansion joint. In alternate embodiments, the length of each stake 80 relative to the height of a side panel 70 might be proportionately different. For example, in an alternate embodiment stakes 80 might be three times longer than a side panel 70 is tall, while in another alternate embodiment stakes 80 might be only twenty-five percent longer than a side panel 70 is tall. In either case, however, the stakes 80 are intended to be long enough to ensure that the frame 40 maintains position during installation of an expansion joint in concrete.

Figure 6:
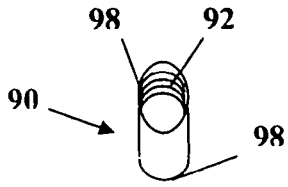
FIG. 6 is a perspective view of a handle receptacle, which is an element of the frame shown in FIG. 1.

Referring now to FIG. 6, a handle receptacle 90 is in the general shape of a cylinder. Handle receptacles 90, in conjunction with a like number of handles 100 (see FIGS. 1 and 2), provide one means for removing a frame 40 from a length of joint material 210 that is held in the frame 40. (See FIG. 11.) The handles 90 also may be gripped by installers in the event the concrete is being poured over loose dirt or the like. The handle receptacle 90 comprises a threaded interior 92 and two opposing ends 98. A first end of the handle receptacle 90 has a flat outer surface that is welded to a spine 50 at its top 56*a*. An opposing end 98 opens to threadedly receive a threaded end 108 of a spaced handle 100.

Referring now to FIG. 3, two spaced handle receptacles 90 are attached to a top side 56*a* of a spine 50, with one handle receptacle 90 located generally at or near a first end 58 of the spine 50 and a second handle receptacle 90 located generally at or near an opposing end 58 of the spine 50. Typically, the flat end 98 of the handle receptacle 90 will be wider than the top side 56*a* of the spine 50. In this instance, the center portion of the flat end 98 of the handle receptacle is adjacent to and attached to the top side 56*a* of the spine 50 with generally equal portions of the flat end 98 extending to either side of the top side 56*a* of the spine 50. In instances where the top side 56*a* of the spine 50 is wider than the flat end 98 of the handle receptacle 90, the flat end 98 is attached to the top side 56*a* of the spine 50 with generally equal portions of the top side 56*a* extending to either side of the flat end 98 of the handle receptacle 90.

Regarding FIG. 3, for frames 40 of longer length, optionally more than two handle receptacles 90 are spacedly attached atop a spine 50. These additional optional handle receptacles 90 are generally equally spaced between a handle receptacle 90 at or near a first end 58 of the spine 50 and a handle receptacle 90 at or near an opposing end 58 of the spine 50. Conversely, in an alternate embodiment, a single handle receptacle 90 is attached atop a shorter spine 50, with the receptacle 90 being positioned generally midway between the two ends 58 of the spine 50.

Figure 5:
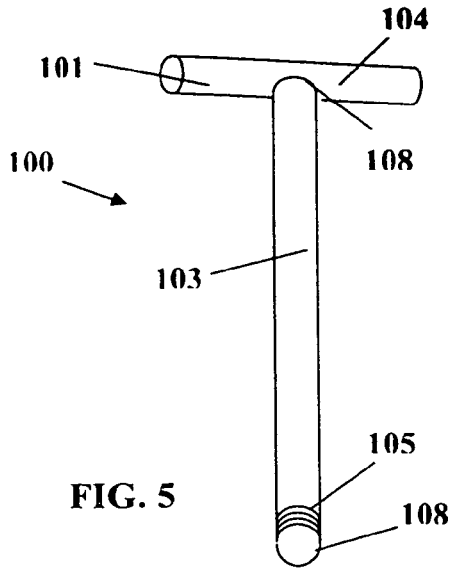
FIG. 5 is a perspective view of a handle, which is an element of the frame shown in FIG. 1.

Referring now to FIG. 5, a handle 100 is in the general shape of a "T" and is formed from two joined cylinders, such as pipe. Handles 100, in conjunction with a like number of handle receptacles 90 (see FIGS. 1 and 2), provide one means for removing a frame 40 from a length of joint material 210 that is held in the frame 40. (See FIG. 11.) The handle 100 comprises a crossbar 101 and a post 103. The crossbar 101 and the post 103 are generally the same diameter, and the crossbar 101 is shorter than the post 103.

Continuing with FIG. 5, the crossbar 101 comprises a surface 104 to which is attached the post 103. The post 103 comprises threads 105 at the lower of two opposing ends 108.

A first end 108 of the post 103 is proximate to the threads 105. The first end 108 fits into a handle receptacle 90, and the proximate threads 105 attach the handle 100 to the handle receptacle 90. A second opposing end 108 of the post 103 is welded to a middle portion of the surface 104 of the crossbar 101 so as to form a "T" shape; consequently, the crossbar 101 and the post 103 of the handle 100 are generally at right angles to each other.

Regarding FIG. 5, for frames 40 of longer length, optionally more than two handles 100 are used, one handle 100 for each handle receptacle 90 mounted atop a spine 50 of a frame 40. Conversely, in an alternate embodiment, a single handle 100 is used for a frame 40 that has only a single handle receptacle 90 attached atop a spine 50 of the frame 40.

Regarding FIGS. 1-6, a frame 40 can be built in various lengths to accommodate the installation of expansion joints. Examples of such lengths include lengths between two and four feet for walkways and lengths between eight and sixteen feet for driveways. A frame 40 can also be built in various heights to accommodate various depths of concrete 220 (see FIG. 11). Examples of such depths include a depth of four inches for walkways and driveways, depths of between six and eight inches for driveways, and a depth of ten or more inches for driveways and foundations. The frame 40 of the present preferred embodiment is constructed of steel. In alternate embodiments, however, a frame 40 might be constructed of other materials, such as other types of metal, hard plastic, or a combination of these or comparable materials.

Description of a Preferred Method

FIGS. 7-11 depict a preferred embodiment of a method for installing lengths of expansion joint material 210 within fresh concrete 220 (see FIG. 11), in accordance with the present invention. The method employs a removable frame 40, as described earlier in FIGS. 1-6, together with extension members such as nails 110 that are used as a means for retaining a length of joint material 210 within fresh concrete 220 when the frame 40 is removed from the joint material 210.

Figure 9:
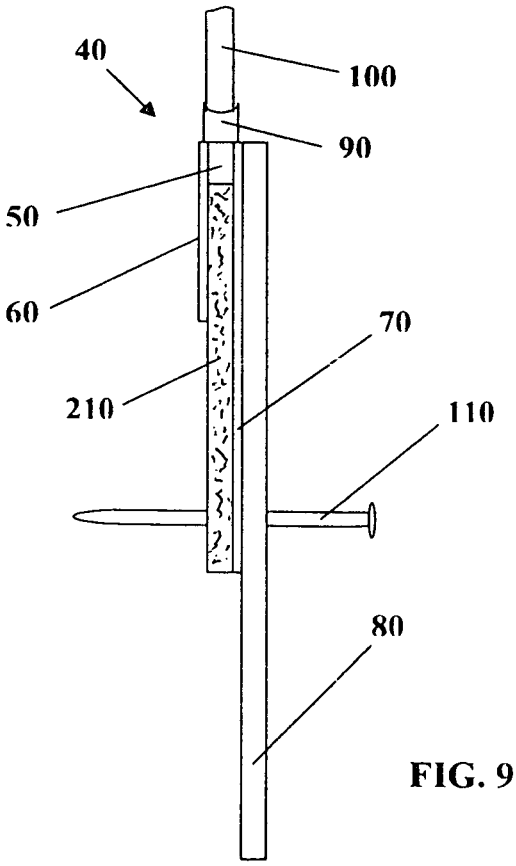
FIG. 9 is an enlarged end view of the frame holding a length of expansion joint material shown in FIG. 7.
Figure 10:
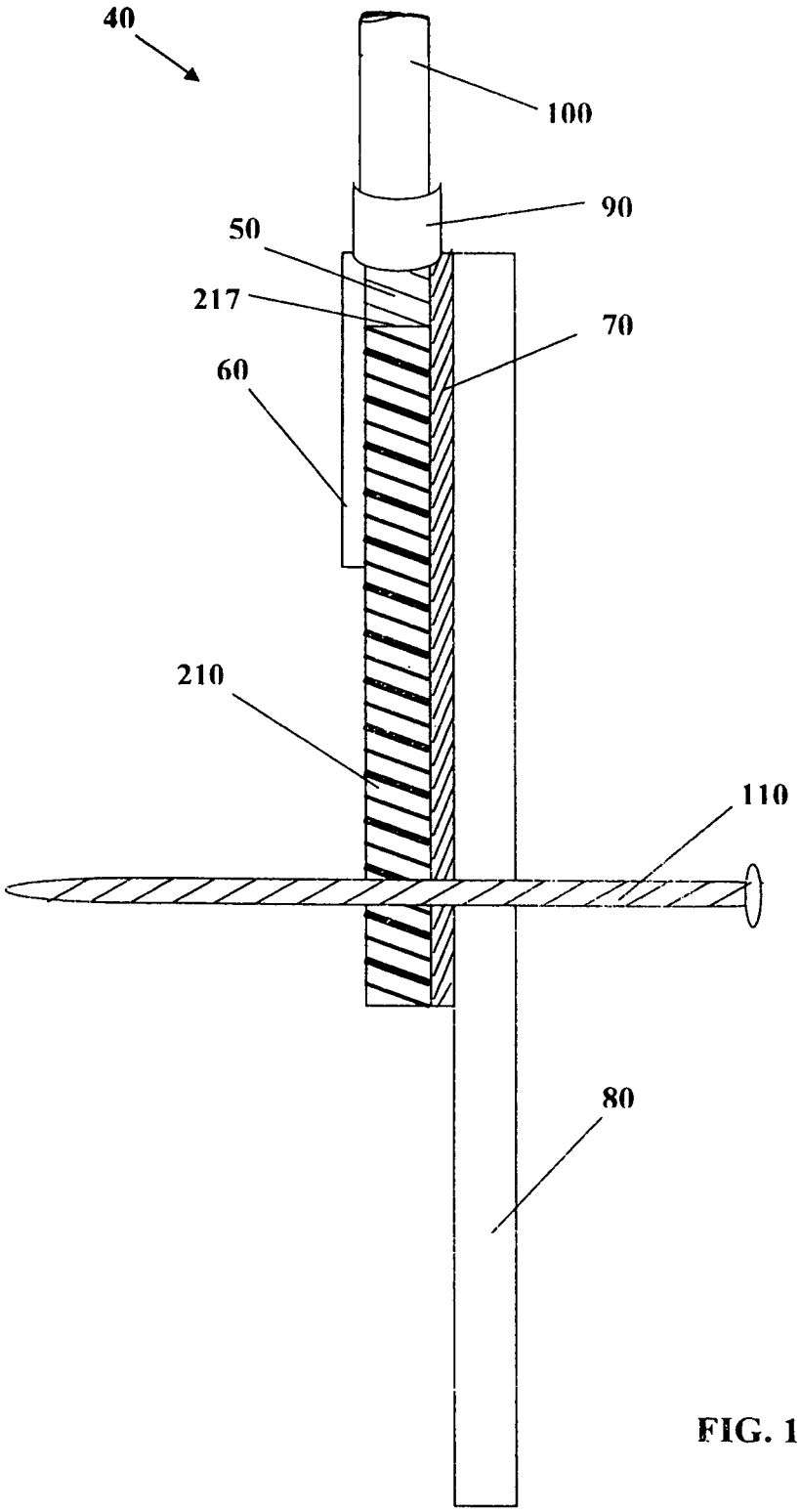
FIG. 10 is an enlarged cross-sectional view of the frame holding a length of expansion joint material shown in FIG. 7 taken along line 10-10.
Figure 11:
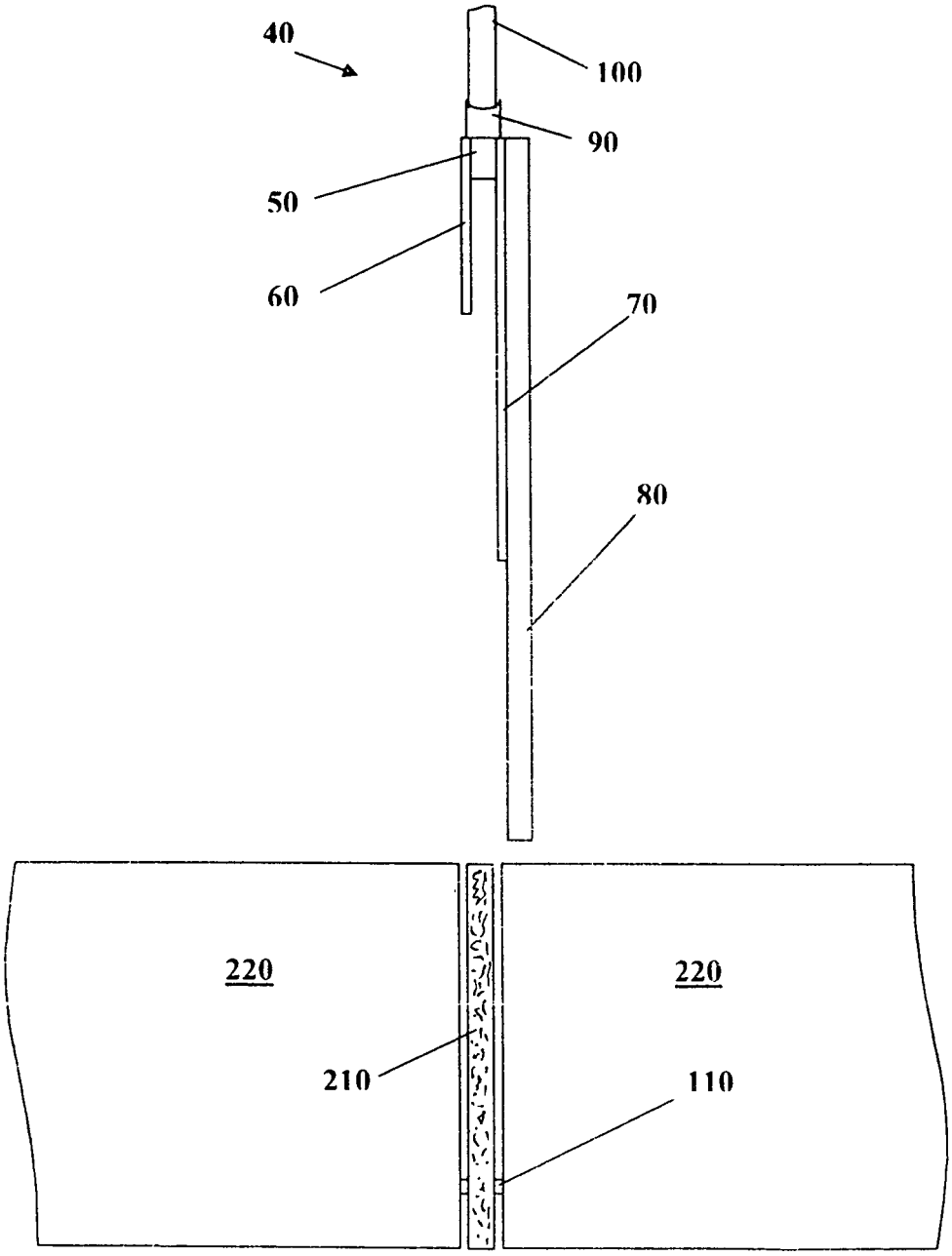
FIG. 11 is a blown up end view of the frame shown in FIG. 7 being removed from a length of expansion joint material, the joint material being left within fresh concrete.

Referring to FIGS. 9-11, a nail 110 is a standard nail 110 of standard size, such as a sixpenny nail 110. Note, however, that nails 110 in a range of sizes will work to retain a length of joint material 210 within concrete 220 when the frame 40 is removed from the joint material 210. (See particularly FIG. 11.) In alternate embodiments, alternatives to nails 110 might be used, such as rods. In other alternate embodiments, other means might be used for retaining a length of joint material 210 within fresh concrete 220 when a frame 40 is removed from the joint material 210. The reason for this is so the ends of the frame 40 will not be in contact with the form boards for the concrete sidewalk, for example, and so the spacing of the form boards will not require precision placement.

Figure 7:
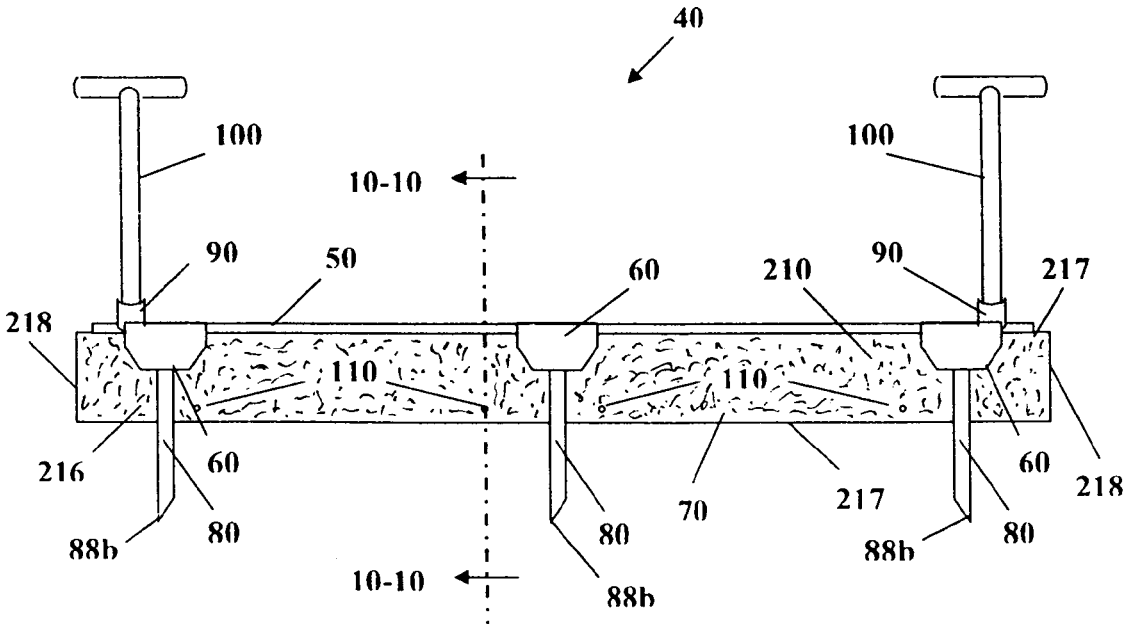
FIG. 7 is a front view of a frame holding a length of expansion joint material, in accordance with the present invention.
Figure 8:
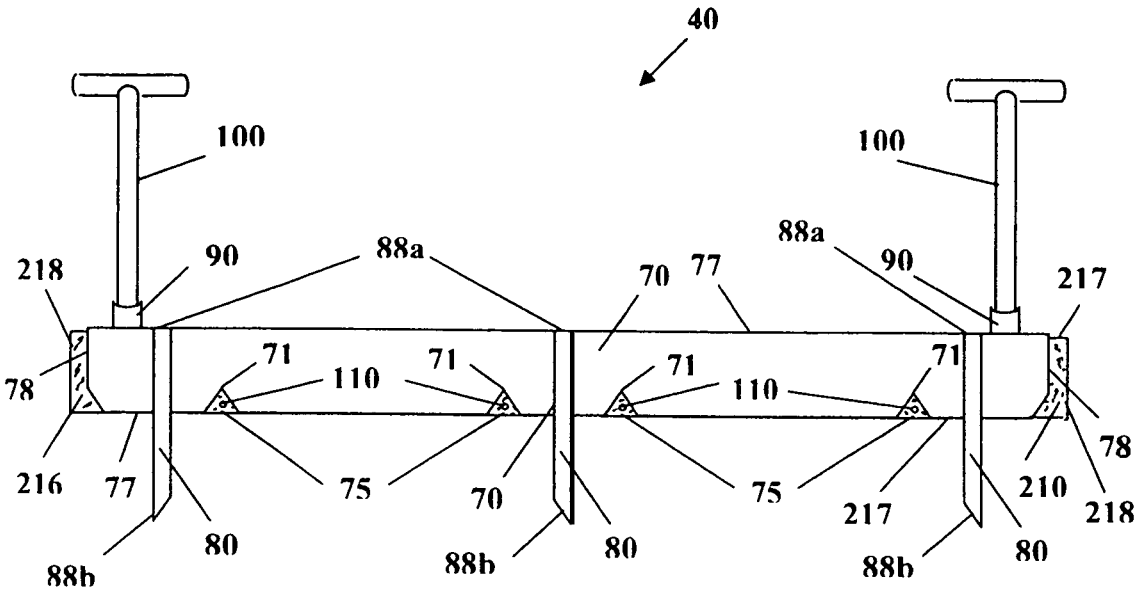
FIG. 8 is a rear view of the frame holding a length of expansion joint material shown in FIG. 7.

Referring to FIGS. 7 and 8, lengths of expansion joint material 210 will have been previously cut to the sizes needed for the expansion joints that are to be installed. A precut length of joint material 210 comprises two opposing sides 216, a plurality of edges 217, and two opposing ends 218, which may extend beyond ends 58 of a spine and ends 78 of a side panel 70.

Referring now to FIGS. 7-11, a method for installing expansion joints in fresh concrete 220 (see FIG. 11) comprises: securing handles 100 to the frame 40; inserting a precut length of joint material 210 into a frame 40; driving nails 110 through the length of joint material 210 using guides 75 (see FIG. 8) in the frame 40; driving stakes 80 of the frame 40 into the ground at the location where the expansion joint is to be installed between side form boards defining the area to be filled with concrete 220; pouring the concrete and roughly smoothing same to a desired level; and removing the frame 40 from the length of joint material 210, leaving the joint material 210 within the fresh concrete 220 (see particularly FIG. 11).

Referring now to FIGS. 5, 7, and 8, handles 100 are secured to the frame 40. Each handle 100 is secured to the frame 40 by inserting an end 108 of the handle 100 that is proximate to threads 105 on the lower portion of a post 103 of the handle 100 into a threaded interior 92 (see FIG. 6) of a handle receptacle 90. A crossbar 101 of the handle 100 is then turned to screw the threads 105 of the handle 100 into the threaded interior 92 of the handle receptacle 90.

Regarding FIGS. 5, 7, and 8, the handles 100 may or may not already be secured to the frame 40, depending upon the preference of the installers. The handles 100 can remain secured to the frame 40 throughout the entire installation process, or the handles 100 can be removed from the frame 40 after installation and again secured to the frame 40 at anytime prior to attempting to detach the frame 40 from the length of joint material 210. The handle 100 is removed from the frame 40 by turning the crossbar 101 of the handle 100 in the opposite direction to the direction that the crossbar 101 was turned when securing the handle 100 to the handle receptacle 90. This unscrews the handle 100 from the frame 40.

Referring now to FIGS. 7 and 8, a precut length of joint material 210 is inserted into a frame 40 in the space between a side panel 70 (see FIG. 8) and retainers 60 (see FIG. 7), such that an inner surface 72 (see FIG. 1) of the side panel 70 is adjacent to a first side 216 of the joint material 210, inner surfaces 62 (see FIG. 2) of the retainers 60 are adjacent to an opposing side 216 of the joint material 210, a top edge 217 (see FIG. 7) of the joint material 210 abuts a bottom side 56*c* (see FIG. 4) of a spine 50 (see FIG. 7) of the frame 40, a bottom edge 217 of the joint material 210 is generally adjacent to a bottom edge 77 (see FIG. 8) of the side panel 70, and each end 218 of the joint material 210 is approximately one-half inch longer than an associated end 78 (see FIG. 8) of the side panel 70.

Regarding FIGS. 7 and 8, note that a length of joint material 210 might be more than one inch longer than the length of the frame 40 or might be the same length as the frame 40 or might even be somewhat shorter than the frame 40 and still be installed properly using the frame 40. At a certain length, however, a length of joint material 210 will be too long for the frame 40 to adequately support the lateral movement of the joint material 210 during installation, resulting in the possible side to side movement of the unsupported portions of the joint material 210.

Referring now to FIGS. 8-10, nails 110 are pushed through or driven through the length of joint material 210 using guides 75 (see FIG. 8) in the frame 40. The pointed end of each nail 110 is aligned generally near an apex 71 (see FIG. 8) of a triangularly-shaped guide 75 below which is housed the length of joint material 210. The nail 110 is driven into the length of joint material 210 beneath the guide 75 so that approximately half of the exposed portion of the nail 110 appears on each side of the joint material 210. Later, concrete 220 (see FIG. 11) will be poured around the joint material 210 and over the nails 110. The fresh concrete 220 will weigh upon the nails 110, thereby holding the nails 110 in place. The nails 110, in turn, will hold the joint material 210 in place in the concrete 220 when the frame 40 is removed from the joint material 210, as described later in FIG. 11.

Regarding FIGS. 8-10, note that the present embodiment calls for at least one nail 110 to be driven through each guide 75 to ensure proper installation of the joint material 210, even though it might be possible that fewer nails 110 would retain the joint material 210 within the concrete 220 when the frame 40 is removed from the joint material 210.

Referring now to FIGS. 7 and 8, stakes 80 of the frame 40 are driven into the ground at the location where the expansion joint is to be installed in the poured concrete 220 (see FIG. 11). The frame 40 is positioned so that pointed ends 88*b* of the stakes 80 contact the ground generally at right angles to the ground. The stakes 80 then are driven into the ground by striking a top side 56*a* (see FIG. 3) of the spine 50 (see FIG. 7) with a hammer. The lower portion of the stakes 80 are driven completely into the ground until the bottom edge 77 (see FIG. 8) of the side panel 70 (see FIG. 8) and the bottom edge 217 of the joint material 210 are generally touching the ground. Note that if the ground is usually uneven, not all portions of the bottom edge 77 of the side panel 70 and the bottom edge 217 of the joint material 210 will touch the ground. If the ground is soft enough, an installer can drive the stakes 80 into the ground perhaps by simply pushing down on the top side 56*a* of the spine 50 with his foot.

Referring now to FIG. 11, the frame 40 is removed from the length of joint material 210, leaving the joint material 210 within fresh concrete 220. The concrete 220 is poured on both sides of the frame 40 to a depth that approximates the height of the length of joint material 210 held by the frame 40. The concrete 220 around the frame 40 is then smoothed until the surface of the concrete 220 is approximately level with the top edge 217 (see FIGS. 7 and 10) of the length of joint material 210. One to two installers then pull up on the handles 100 of the frame 40. The fresh concrete 220 weighs down upon the nails 110 that were driven laterally into the length of joint material 210. (See also FIGS. 9 and 10.) The weight of the concrete 220, together with its viscosity, keeps the nails 110 in place, and the nails 110, in turn, keep the joint material 210 in place as the frame 40 is pulled away from the joint material 210 and the concrete. The joint material 210 remains within the concrete 220 while the frame 40 is removed from the joint material 210 and laid aside. Installation of the expansion joint is now complete and further smoothing of the concrete may be in order.

Regarding FIG. 11, note that for frames 40 of longer length, optionally more than two handles 100 are attached to the frame 40 and used to remove the frame 40 from the joint material 210. In this case, more than two installers might be needed to pull up on the handles 100 of the frame 40.

Although the present invention has been described in detail herein with reference to certain preferred embodiments, other embodiments are possible. For example, in an alternate embodiment, a side panel 70 might be replaced by a second plurality of wider and taller retainers 60. In another alternate embodiment, the bottom edge 217 of a length of expansion joint material might extend slightly beyond the bottom edge 77 of a side panel 70. In yet another alternate embodiment, the edges 67 of retainers 60 or the ends 78 of a side panel 70 or both the edges 67 of retainers 60 and the ends of a side panel 70 might extend beyond one or both ends 58 of a spine 50 such that the spine 50 does not define the length of a frame 40. Such alterations in the characteristics of a frame 40 as might be presented by these and other alternate embodiments could, in turn, engender modifications to the method for installing expansion joints as described in a preferred embodiment. Therefore, the spirit and scope of the appended claims should not be limited to the description of the preferred embodiments contained herein.

What is claimed is:

1. Apparatus for holding a strip of expandable joint material to be installed in an expansion joint between layers of freshly poured cementitious material, said apparatus comprising:

a holder having a receiver of an elongated dimension generally corresponding to a strip of expandable joint material to be inserted in said receiver, said receiver including means for holding a strip of expandable joint material in said receiver while cementitious material is poured in areas on either side or on both sides of and adjacent to said holder, said apparatus including a plurality of integral stakes for substantially maintaining said receiver in a predetermined position while cementitious material is poured into said areas, a plurality of vertically elongated T-shaped spaced handles for lifting said apparatus and releasing said strip of expandable joint material from said receiver after cementitious material is poured and the apparatus is removed from between the areas of poured cementitious material prior to any setting of the cementitious materials;

said holder including first and second opposing members forming said receiver, said first opposing member being oriented substantially parallel to said second opposing member, and with a space therebetween for receiving and frictionally maintaining said strip of expandable joint material, said strip of expandable joint material being longer than said receiver elongated dimensions;

said receiver having an elongated continuous spine to which said first and second opposing members are integrally attached, said spine being dimensioned to maintain said space between said first and second members to accommodate said strip of expandable joint material;

said first of said opposing members includes a plurality of widely spaced small retainers, with each said retainer being a substantially flat plate and having an inner surface, an outer surface, and a plurality of edges, a lower of said edges terminating generally midway of a top edge and a bottom edge of said second of said opposing members;

said retainers being oriented with each said inner surface of each said retainer facing said second member inner surface and forming the means for holding a strip of expandable joint material;

said inner surface of said second member being substantially parallel to said inner surfaces of said retainers;

said spine includes two opposing ends and a plurality of sides, a first side of said spine opposing a second side of said spine, a top side of said spine having a substantially flat surface that is substantially perpendicular to both said first and second sides of said spine;

each said retainer being attached to said first side of said spine only by a portion of said inner surface of each said flat plate proximate to a first edge of each said flat plate such that said first edge of each said flat plate is generally coplanar with said top side of said spine; and said second opposing member extending substantially along said spine and being integrally attached to said opposing second side of said spine by a portion of said inner surface of said second opposing member proximate to a first longitudinal edge of said second member, such that said first longitudinal edge of said second opposing member is generally coplanar with said top side of said spine; and said second opposing member having an opposing second longitudinal edge spaced above said strip of expandable joint material in a direction coplanar with said inner surface of said second opposing member when said strip of expandable joint material has been substantially fully received into said space for receiving said strip of expandable joint material.

2. The apparatus recited in claim 1, wherein said means for substantially maintaining said apparatus in a predetermined position include a plurality of elongated, generally vertical and pointed stakes integrally attached to and spaced along said second opposing member;

each said stake includes a plurality of sides, a generally pointed end, and an opposing flat end;

a first side of each said stake being attached to said outer surface of said second opposing member of said apparatus, each said stake being disposed perpendicular to said first and second longitudinal edges of said second member, said pointed end of each said stake extending beyond said second longitudinal edge of said second member in a direction coplanar with said inner surface of said second member, said flat end of each said stake being generally parallel with and adjacent to said first longitudinal edge of said second member and substantially flush with said top side of said spine;

said stakes being generally equally spaced along said outer surface of said second opposing member of said apparatus; and each of said pointed ends of said stakes extending beyond said second longitudinal edge of said second member of said apparatus remote from a bottom edge of said second opposing member to substantially maintain said apparatus in said predetermined position when said stakes are forcibly inserted into a surface onto which cementitious material is to be poured.

3. The apparatus recited in claim 1 further comprising a plurality of generally cylindrical spaced receptacles for receiving respective said handles;

each said handle having a generally cylindrical elongated post, having a two hand gripping upper end and a lower threaded end;

each said receptacle having a closed lower end, an open upper end, having a threaded interior for receiving said lower threaded end of said post;

each of said closed end of each said receptacle being integrally attached to said top side of said spine, said open upper end of each said receptacle removably respectively receiving said threaded end of said post;

said post respectively received into each said receptacle positions each said post substantially perpendicular to said top side of said spine; and a first of said receptacles is positioned adjacent one end of said spine and a second of said receptacles is positioned adjacent an opposing end of said spine, with any other of remaining said receptacles being substantially equally spaced between said opposing ends of said spine.

4. The apparatus recited in claim 1, wherein said second opposing member includes a plurality of small spaced notches along said bottom edge of said second member terminating closely adjacent said bottom edge and remote from said top side of said spine for receiving spaced extension members passing through and supported only by said strip of expandable joint material, said extension members terminating in free ends generally equally on both sides of said expansion joint material and said first and second opposing members.

5. The apparatus recited in claim 1, further comprising a plurality of spaced short extension members passing perpendicularly through and supported only by said strip of expandable joint material and terminating closely on each side of said apparatus.

6. A method for installing a strip of expandable material releasably held in the apparatus of claim 1 as an expansion joint between layers of freshly-poured cementitious material, said method comprising the steps of:

a) frictionally fitting the strip of expandable material with the apparatus such that the pressure of the poured layer holds the strip in the joint cementitious material during removal of the apparatus;

b) removably attaching the strip of expandable material to the apparatus having an elongated dimension generally corresponding to an expansion joint into which the strip is to be inserted into and removed from a space defining the expansion joint before pouring of the cementitious material;

c) pouring the layer of cementitious material adjacent to and in contact with either or both sides of expandable material; and d) removing the apparatus from the strip prior to any setting of the cementitious material and leaving the strip of expandable material in the cementitious material and defining the expansion joint.

7. The method of claim 6 further comprising the step of installing spaced extensions laterally through and supported only by the strip of expandable material adjacent the bottom of same and terminating closely beyond and on each side of the apparatus for engagement with the poured layer thereabove to assist in overcoming the frictional fit between the apparatus and the strip of expandable material leaving the strip of expandable material in situ upon removal of the apparatus.

8. A method for installing a strip of expandable material releasably held in an apparatus as an expansion joint between two layers of freshly poured cementitious material, the method comprising the steps of:

a) providing a strip of expandable material having a length, width and a height corresponding to an expansion joint into which the strip is insertable in the freshly poured cementitious material;

b) frictionally fitting the strip of expandable material to an apparatus having an elongated side member and a plurality of spaced retainers forming a furcated side member and an elongated flat to spine therebetween with the expandable material engaging the spine and the side members and a plurality of elongated spaced stakes integral with only the elongated side member and having pointed ends extending remote from the lower portion of the elongated side member and a plurality of vertically elongated upright detachable and attachable t-shaped handles for workers to grip and remove the apparatus after pouring of the cementitious material and smoothing to adjacent the top of the strip of expandable material, a portion of the apparatus dimensioned to be inserted into and removed from a space substantially defining the expansion joint before pouring of the cementitious material;

c) installing short extensions laterally through and supported only by the strip of expandable material remote from the top of same and closely adjacent the bottom of same for engagement with the poured layers thereabove to assist in overcoming the frictional fit between the apparatus and the strip of expandable material to retain the strip in situ between the poured layers;

d) positioning the apparatus between spaced form boards;

e) pouring one or two layers of cementitious materials adjacent to and in contact with either or both of the opposing sides of the strip of expandable material with the extensions being remote from the top and closely adjacent the bottom of the poured layers; and f) removing prior to any setting of the cementitious materials the apparatus by gripping and elevating the t-shaped handles by the two hands of at least a pair of workers out of contact from the poured layers and, leaving in situ the strip of expandable material as the expansion joint.

* * * * *